US006092676A

United States Patent [19]

Graham

[11] Patent Number: 6,092,676

[45] Date of Patent: Jul. 25, 2000

[54] PLATE RAIL

[76] Inventor: Norman G. Graham, 8831 S. 42nd St., Franklin, Wis. 53132

[21] Appl. No.: 09/309,079

[22] Filed: May 10, 1999

[51] Int. Cl.[7] ..... A47F 7/00

[52] U.S. Cl. ..... 211/94.01; 211/41.2; 211/41.7; 211/175; 248/473

[58] Field of Search ..... 211/41.2, 41.7, 211/94.01, 162, 86.01, 175, 43; 248/473, 441.1, 346.5

[56] References Cited

U.S. PATENT DOCUMENTS

| | | |
|---|---|---|
| 490,569 | 1/1893 | Lehman . |
| 905,737 | 12/1908 | McCombe . |
| 906,809 | 12/1908 | Lillibridge . |
| 1,215,834 | 2/1917 | May . |
| 2,454,516 | 11/1948 | Laureyns . |
| 3,272,183 | 9/1966 | Craighead et al. . |
| 3,282,437 | 11/1966 | Hansen . |
| 4,957,263 | 9/1990 | Leluan ..... 248/473 |
| 4,976,409 | 12/1990 | Hansen ..... 248/473 X |
| 5,145,074 | 9/1992 | Miley . |

*Primary Examiner*—Robert W. Gibson, Jr.
*Attorney, Agent, or Firm*—Andrus, Sceales, Starke & Sawall

[57] ABSTRACT

A plate rail is provided by a base having an upstanding arm removably mounted thereto in nested interlocking relation and having a support position supporting the backside of a plate leaning thereagainst such that the frontside of the plate is displayed, and having a released position enabling removal of the arm from the base. The base has a slot extending longitudinally left-right therealong, and the arm has a lower portion received in the slot and movable left-right therealong to vary the location of the plate along the base. The arm is tiltable forwardly from the support position to the released position to enable removal. Different height arms are used for different size plates.

20 Claims, 2 Drawing Sheets

FIG. 4
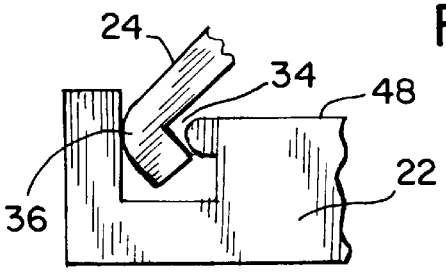
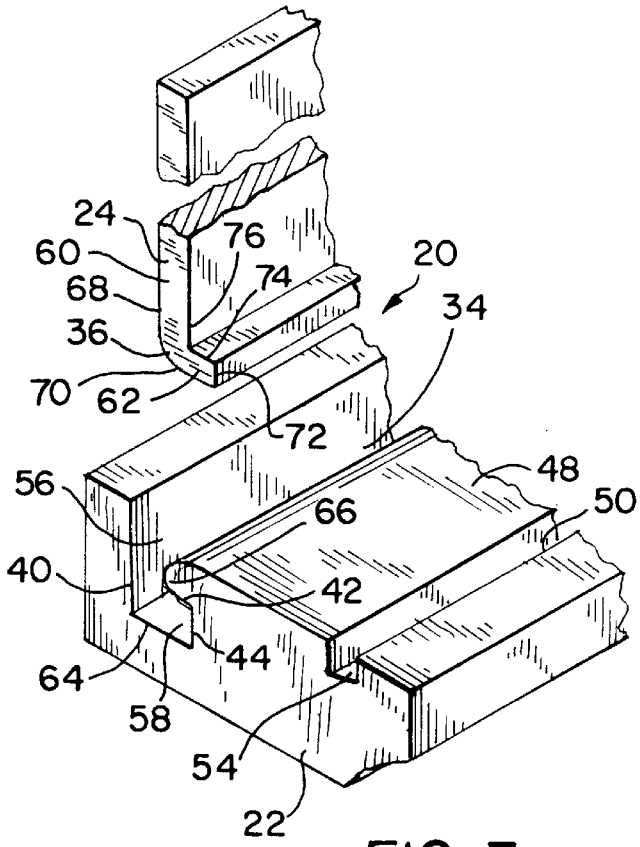
FIG. 3
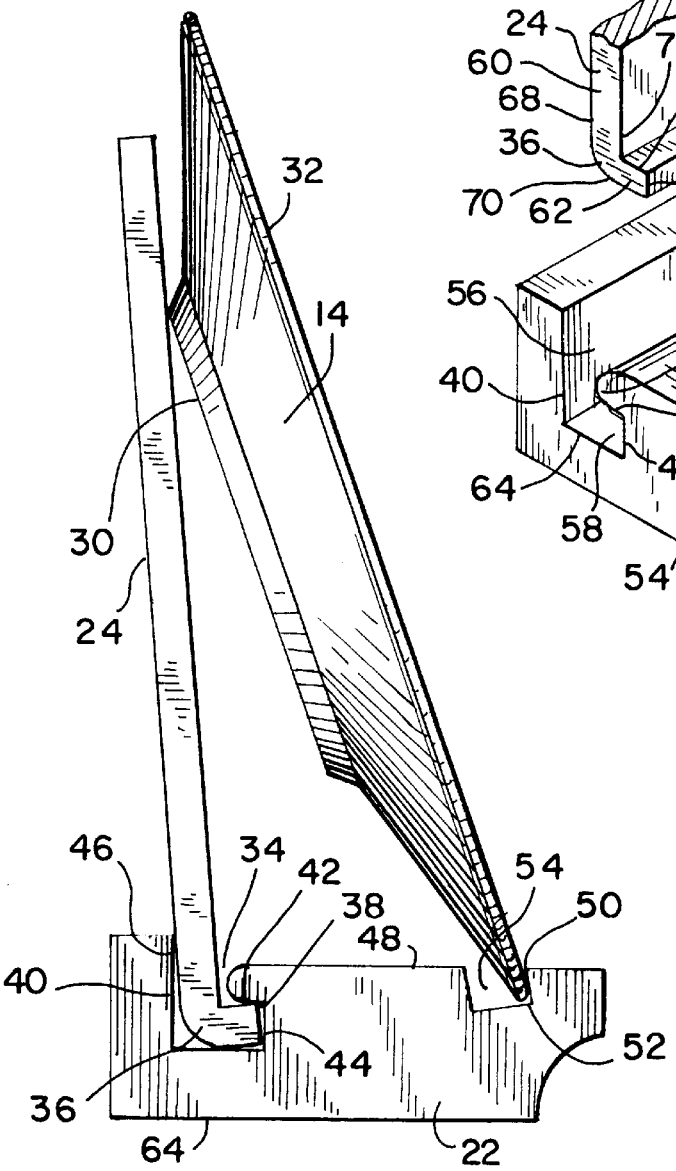
FIG. 5

PLATE RAIL

BACKGROUND AND SUMMARY

The invention relates to plate rails for supporting a plate on a generally horizontal surface such as the top of a cabinet or the like, for displaying the frontside of the plate.

Plate rails are known in the prior art. One type of plate rail is provided by a curb extending along the top of a cabinet, and a backstop provided by a board or the back wall. The lower edge of the plate rests on the top of the cabinet and is stopped against the front curb, and the backside of the plate leans against the backstop, board or wall, such that the frontside of the plate is displayed. The curb may have a plurality of spindles extending upwardly and supporting an upper rail for decoration.

Another type of plate rail involves a triangular support having a pair of lower curbs or stops spaced apart and engaging the lower edge of the plate, and a central backing arm engaging the backside of the plate near the top thereof. One such supporting member is needed for each plate.

The present invention provides a simple plate rail which is particularly cost effective and easy to install and use. The present plate rail includes a base having an upstanding arm removably mounted thereto in nested interlocking relation and having a support position supporting the backside of a plate leaning thereagainst such that the frontside of the plate is displayed, and having a released position enabling removal of the arm from the base. The arm is movable left-right along the base in the support position to vary the location of the plate along the base. The arm is tiltable forwardly from the support position to the released position to enable removal. Different height arms may be used to support and display different size plates.

BRIEF DESCRIPTION OF THE DRAWINGS

FIG. 3 is an exploded perspective view of a portion of the structure of FIG. 2.

FIG. 4 is a side elevation view of a portion of the structure of FIG. 3.

FIG. 5 is a side elevation view of a portion of the structure of FIG. 2.

DETAILED DESCRIPTION OF THE INVENTION

Figure 1:
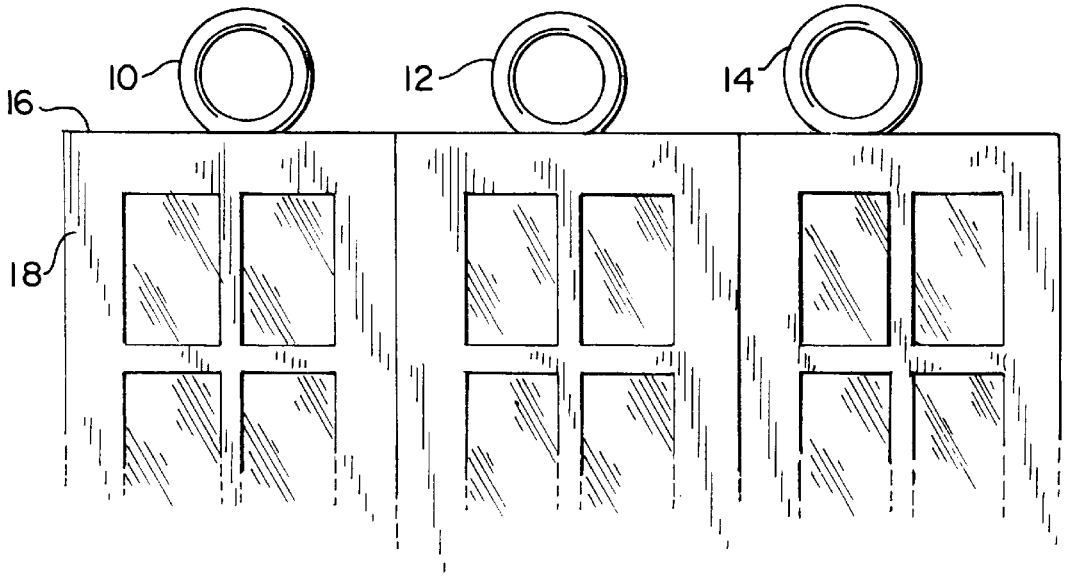
FIG. 1 is a front elevation view of plates displayed on a cabinet top.
Figure 2:
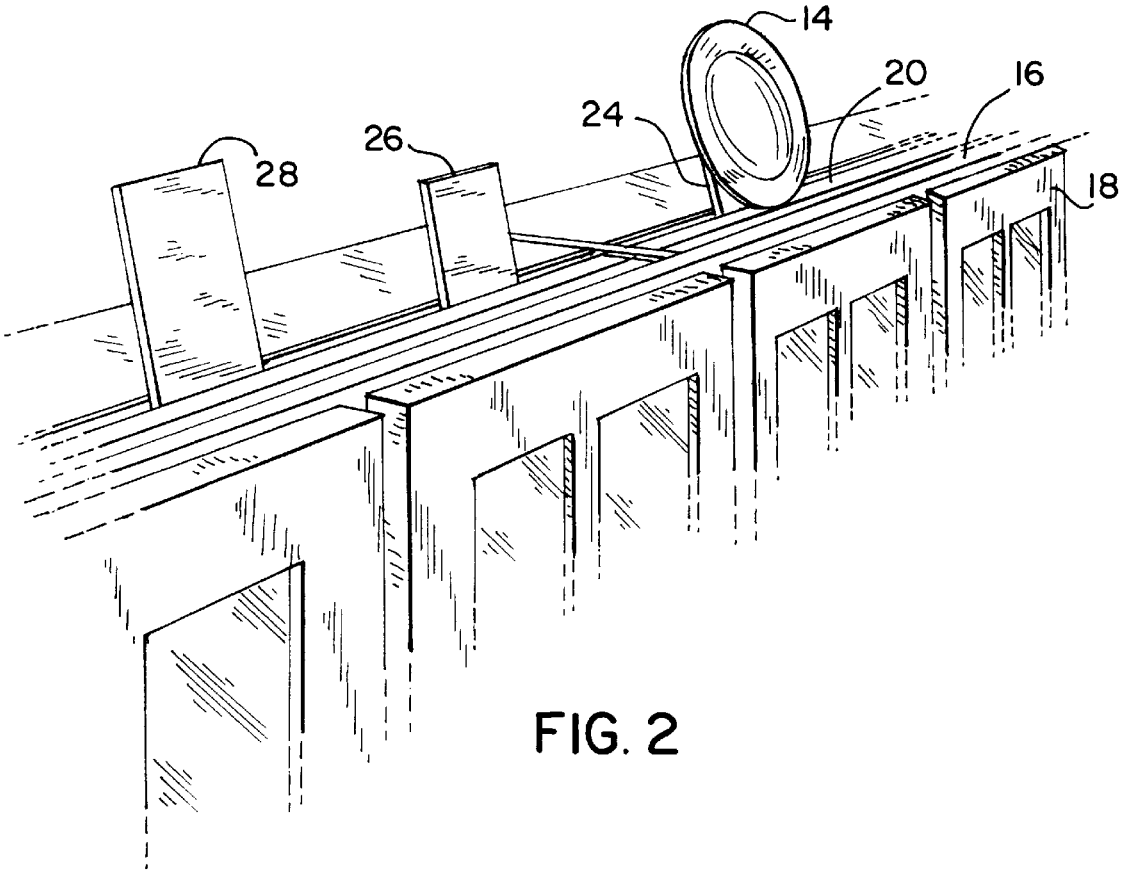
FIG. 2 is a top perspective view of a portion of FIG. 1.

FIG. 1 shows a plurality of plates such as 10, 12, 14 supported on a generally horizontal surface 16 such as the top of a cabinet 18 or the like. A plate rail 20, FIG. 2, is provided for supporting the plates on surface 16. Plate rail 20, FIGS. 3–5, includes a base 22 having an upstanding arm 24 removably mounted thereto in nested interlocking relation. Base 22 is mounted to top surface 16 of the cabinet in any suitable manner, such as with glue, nails, screws, bolts, etc. The support arm may have different heights, for example as shown at different size support arms 26, 28, FIG. 2, for supporting and displaying different size plates. Each support arm has a support position, as shown in FIG. 5, supporting the backside 30 of the plate leaning thereagainst such that the frontside 32 of the plate is displayed. Each support arm has a released position, as shown in FIG. 4, enabling removal of the support arm from the base. Each arm is movable left-right, as viewed in FIG. 1, along the base in the support position, FIG. 5, to vary the location of the plate along the base. Each arm is tiltable forwardly, FIG. 4, from the support position, FIG. 5, to the released position, FIG. 4, to enable the noted removal. Base 22 has a slot 34 extending longitudinally left-right therealong. Each arm 24, 26, 28 is received in slot 34 and is slidable left-right therealong. Each arm has a lower end 36, FIGS. 3–5, received in slot 34 and supporting the arm to extend upwardly therefrom to in turn support the respective plate.

Slot 34 has a front wall 38, FIG. 5, and a back wall 40. Arm 24 extends downwardly into slot 34 and coacts therewith such that the arm can rock back slightly, FIG. 5, until the front of the arm is stopped by front wall 38 and the back of the arm is stopped by back wall 40. The front of the arm is stopped by engagement with horizontal surface 42 and/or vertical surface 44 of front wall 38, and the back of the arm is stopped by engagement with the upper end 46 of back wall 40. Arm 24 is removable from slot 34 without left-right sliding by rocking the arm forwardly, FIG. 4, and then removing the arm upwardly and forwardly from base 22. The front wall of the slot has a lower height than the back wall of the slot. The back of arm 24 is engaged by back wall 40, FIG. 5, at a point along the arm vertically spaced above the point of engagement of the front of the arm by the front wall of the slot. The point of engagement of the back of the arm by the back wall of the slot is also vertically spaced above the upper reach of the front wall of the slot.

Base 22 has an upper surface 48 extending from slot 34 forwardly to a forward stop 50. Lower edge 52 of plate 14 is engaged against forward stop 50 to stop forward sliding thereof. Forward stop 50 is provided by a second slot 54 extending longitudinally left-right along base 22 parallel to slot 34 and spaced forwardly thereof.

Slot 34 in base 22 is L-shaped and has a first downwardly extending section 56, FIG. 3, and a second forwardly extending section 58. Arm 24 is L-shaped and has a first downwardly extending segment 60 and a second forwardly extending segment 62. Arm segment 60 is received in slot section 56, and arm segment 62 is received in slot section 58. Arm segment 60 is substantially longer than arm segment 62 and extends upwardly out of slot section 56 for supporting plate 14. As noted above, plate 14 has a lower edge 52 resting on base 22, a backside 30 leaning against arm segment 60, and a front display side 32 facing in the opposite direction from arm segment 60. Arm 24 is removable from slot 34 without left-right sliding by tilting arm segment 60 forwardly about a pivot point at the intersection of arm segments 60 and 62 until arm segment 62 clears slot section 58, and then removing the tilted arm forwardly and upwardly from base 22.

Slot 34 in base 22 is formed by a first downwardly extending wall 40, a second wall 64 extending forwardly from first wall 40, a third wall 44 extending upwardly from second wall 64, a fourth wall 42 extending rearwardly from third wall 44, and a fifth wall 66 extending upwardly from fourth wall 42. Base 22 has the noted upper surface 48 extending forwardly from fifth wall 66 to the forward stop provided by second slot 54. Upstanding arm 24 has the noted lower end received in nested relation in slot 34 and having a first surface 68 extending downwardly and facing rearwardly toward first wall 40, a second surface 70 extending forwardly from first surface 68 and facing downwardly toward second wall 64, a third surface 72 extending upwardly from second surface 70 and facing forwardly toward third wall 44, a fourth surface 74 extending rearwardly from third surface 72 and facing upwardly toward fourth wall 42, and a fifth surface 76 extending upwardly from fourth surface 74 and facing forwardly toward fifth wall 66. Arm 24 has the noted upper portion 60 extending upwardly from first and fifth surfaces 68 and 76 substantially beyond first and fifth walls 40 and 66 and beyond upper surface 48 of base 22 to provide support for plate 14. The upper reach of first wall 40 of slot 34 is above upper surface 48 of base 22. As above noted, slot 34 extends longitudinally left-right along base 22. Arm 24 is slidable left-right along slot 34 while still in the noted nested interlocking relation in the base, to vary the location of arm 24 along base 22, to vary the location of the displayed plate. Fifth wall 66 of slot 34 is spaced forwardly of first wall 40 by a sufficient distance to enable forward tilting of the upper portion of arm 24, FIG. 4, about a pivot point at the junction of fourth and fifth surfaces 74 and 76, followed by forward and upward movement of the arm to remove the arm from base 22.

It is recognized that various equivalents, alternatives and modifications are possible within the scope of the appended claims.

What is claimed is:

1. A plate rail for supporting a plate on a generally horizontal surface, such as the top of a cabinet or the like, comprising a base having an upstanding arm removably mounted thereto in nested interlocking relation and having a support position supporting the backside of a plate leaning thereagainst such that the frontside of the plate is displayed, and having a released position enabling removal of said arm from said base, said arm being movable left-right along said base to vary the location of said plate along said base, said arm being tiltable forwardly from said support position to said released position to enable said removal.

2. The invention according to claim 1 wherein said arm is movable left-right along said base while said arm is in said support position.

3. The invention according to claim 1 wherein said base has a slot extending longitudinally left-right therealong, said arm has a lower portion received in said slot and slidable left-right therealong to vary the location of said arm along said base and supporting said arm to extend upwardly therefrom to in turn support said plate having said backside leaning against said arm and having a front display side facing in the opposite direction from said arm.

4. The invention according to claim 3 wherein said slot has a front wall and a back wall, and wherein said arm extends downwardly into said slot and coacts therewith such that said arm can rock back slightly until the front of said arm is stopped by said front wall and the back of said arm is stopped by said back wall.

5. The invention according to claim 4 wherein said arm is removable from said slot without left-right sliding by rocking said arm forwardly and then removing said arm from said base.

6. The invention according to claim 4 wherein said walls have unequal height.

7. The invention according to claim 4 wherein said back of said arm is engaged by said back wall at a point along said arm vertically spaced above the point of engagement of said front of said arm by said front wall.

8. The invention according to claim 7 wherein said point of engagement of said back of said arm by said back wall is also vertically spaced above the upper reach of said front wall.

9. The invention according to claim 3 wherein said base has an upper surface extending from said slot forwardly to a forward stop, and wherein said plate has a lower edge engaged against said forward stop to stop forward sliding thereof.

10. The invention according to claim 9 wherein said base has a second slot extending longitudinally left-right therealong parallel to said first mentioned slot and spaced forwardly thereof, said second slot providing said forward stop.

11. A plate rail for supporting a plate on a generally horizontal surface, such as the top of a cabinet or the like, comprising a base having an L-shaped slot extending longitudinally left-right therealong, said slot having a first downwardly extending section and a second forwardly extending section, an L-shaped arm having a first downwardly extending segment, and a second forwardly extending segment, said first segment received in said first section, said second segment received in said second section, said first segment being substantially longer than said second segment and extending upwardly out of said first section for supporting a plate having a backside leaning against said first segment, and a front display side facing in the opposite direction from said first segment.

12. The invention according to claim 11 wherein said slot has a back wall along said first section, and a front wall along said second section, and wherein said arm extends into said slot and coacts therewith such that said arm can rock back slightly until said first segment engages said back wall in said first section, and said second segment engages said front wall in said second section.

13. The invention according to claim 12 wherein said arm is removable from said slot without left-right sliding by tilting said first segment forwardly about a pivot point at the intersection of said first and second segments until said second segment clears said second section and then removing the tilted arm forwardly and upwardly from said base.

14. The invention according to claim 13 wherein said base has an upper surface extending from said slot forwardly to a forward stop, and wherein said plate has a lower edge engaged against said forward stop to stop forward sliding thereof.

15. The invention according to claim 14 wherein said base has a second slot extending longitudinally left-right therealong parallel to said first mentioned slot and spaced forwardly thereof, said second slot providing said forward stop.

16. The invention according to claim 14 wherein said back wall of said first section extends to a height above said upper surface.

17. A plate rail for supporting a plate on a generally horizontal surface, such as the top of a cabinet or the like, comprising a base having a slot formed by a first downwardly extending wall, a second wall extending forwardly from said first wall, a third wall extending upwardly from said second wall, a fourth wall extending rearwardly from said third wall, and a fifth wall extending upwardly from said fourth wall, said base having an upper surface extending forwardly from said fifth wall to a forward stop, an upstanding arm having a lower end received in nested relation in said slot and having a first surface extending downwardly and facing rearwardly toward said first wall, a second surface extending forwardly from said first surface and facing downwardly toward said second wall, a third surface extending upwardly from said second surface and facing forwardly toward said third wall, a fourth surface extending rearwardly from said third surface and facing upwardly toward said fourth wall, and a fifth surface extending upwardly from said fourth surface and facing forwardly toward said fifth wall, said arm having an upper portion extending upwardly from said first and fifth surfaces substantially beyond said first and fifth walls and said upper surface of said base to support a plate having a lower edge resting against said forward stop, a backside leaning against said upper portion of said arm, and a front display side facing forwardly.

18. The invention according to claim 17 wherein the upper reach of said first wall of said slot is above said upper surface of said base.

19. The invention according to claim 17 wherein said slot extends longitudinally left-right along said base, and wherein said arm is slidable left-right along said slot to vary the location of said arm along said base.

20. The invention according to claim 19 wherein said fifth wall of said slot is spaced forwardly of said first wall of said slot by a sufficient distance to enable forward tilting of said upper portion of said arm about a pivot point at the junction of said fourth and fifth surfaces followed by forward and upward movement of said arm to remove the latter from said base.

* * * * *